US011051378B2

(12) United States Patent
Li et al.

(10) Patent No.: US 11,051,378 B2
(45) Date of Patent: Jun. 29, 2021

(54) ELIMINATING FLICKER AND OPEN LOAD PROTECTION FOR DRIVER COMPATIBLE WITH NAFTA DIM ECG

(71) Applicant: LEDVANCE GmbH, Garching bei Munich (DE)

(72) Inventors: Zhifeng Li, Guangdong (CN); Hui Ye, Guangdong (CN)

(73) Assignee: LEDVANCE GMBH, Garching bei Munich (DE)

( * ) Notice: Subject to any disclaimer, the term of this patent is extended or adjusted under 35 U.S.C. 154(b) by 0 days.

(21) Appl. No.: 16/128,090

(22) Filed: Sep. 11, 2018

(65) Prior Publication Data

US 2019/0098711 A1 Mar. 28, 2019

(30) Foreign Application Priority Data

Sep. 28, 2017 (CN) ..... 201710897613.3

(51) Int. Cl.
*H05B 45/30* (2020.01)
*H05B 45/50* (2020.01)
*H05B 45/37* (2020.01)
*H05B 45/00* (2020.01)

(52) U.S. Cl.
CPC ..... *H05B 45/37* (2020.01); *H05B 45/00* (2020.01); *H05B 45/50* (2020.01)

(58) Field of Classification Search
CPC ..... H05B 33/08; H05B 33/0809; H05B 33/0815; H05B 33/0818; H05B 33/0851; H05B 33/0887; H05B 33/089; H05B 45/00; H05B 45/10; H05B 45/30; H05B 45/395; H05B 45/50; H05B 45/3578; H02M 1/15; H02M 1/34; H02M 1/44
See application file for complete search history.

(56) References Cited

U.S. PATENT DOCUMENTS

| | | | | |
|---|---|---|---|---|
| 9,572,215 | B2 * | 2/2017 | Datta | H05B 33/0845 |
| 10,129,939 | B1 * | 11/2018 | Zhang | H05B 45/395 |
| 2007/0182347 | A1 * | 8/2007 | Shteynberg | H05B 45/37 315/312 |
| 2007/0188114 | A1 * | 8/2007 | Lys | H02M 1/4225 315/308 |
| 2012/0081009 | A1 * | 4/2012 | Shteynberg | H05B 33/083 315/122 |
| 2016/0278173 | A1 * | 9/2016 | Chang | H05B 45/395 |

* cited by examiner

*Primary Examiner* — Thai Pham
(74) *Attorney, Agent, or Firm* — Hayes Soloway PC

(57) ABSTRACT

An electronic driver for transforming an electronic ballast input voltage into an operating voltage for an LED lighting module. The driver includes a flicker eliminating circuit, which is adapted to operate in a saturation mode when the input voltage is below a threshold voltage. It operates in a switch mode when the input voltage is above a threshold voltage. A voltage drop in the flicker eliminating circuit in the saturation mode is higher than in the switch mode.

17 Claims, 4 Drawing Sheets

ELIMINATING FLICKER AND OPEN LOAD PROTECTION FOR DRIVER COMPATIBLE WITH NAFTA DIM ECG

CROSS-REFERENCE

This patent application claims the benefit of and priority to Chinese Patent Application No. 2017108976133 filed on Sep. 28, 2017, the entire disclosure of which is incorporated herein by reference.

TECHNICAL FIELD

The present application relates to an electronic driver for an LED lighting module and an LED lamp.

TECHNICAL BACKGROUND

For years, fluorescent lamps have been commonly known and widespread lighting modules as efficient alternatives for incandescent light bulbs. However, with the advent of LED lamp, even more efficient and long-lived lighting means are available. Therefore, there is a demand for replacing existing fluorescent lamps with LED lamps.

Currently available fluorescent lamps are usually operated with an electrical ballast (also called electronic control gear, ECG) for regulating and limiting the current that is provided to the fluorescent lamp and for providing an ignition voltage during a startup process of the fluorescent lamp. The electrical ballast is part of the lamp fixture for the fluorescent lamp.

Replacing existing electrical ballasts in existing lamp fixtures would be labor-intensive and thus requires substantial expenses. Therefore, operating LED lamps with already installed electrical ballasts is favorable. In order to provide an LED lamp that is compatible with the electrical ballast, currently available LED lamps comprise electronic drivers for adapting the voltage and/or current provided by the ballast to the requirements of the lighting module of the LED lamp, which comprises the light-emitting diodes. Otherwise, electronic and/or optoelectronic components of the LED lamp might be damaged or destroyed by the ballast due to high voltages that are produced during the starting sequence. Further, since the power consumption of an LED lamp is lower than that of a fluorescent lamp, without the electronic driver, the electrical ballast would operate in an unstable status.

However, currently available electronic drivers have some disadvantages. For example, during the preheating stage, flickering of the LED lamp might occur due to an unstable input current provided by the electrical ballast. Further, after ignition, flickering of the LED lamp could occur, in particular in the case of the LED lamp being dimmed with a dimmer. In general, the flickering may be due to a combination of a low output power and the ripple current provided by the electrical ballast.

One solution to these problems would be to increase the power consumption of the LED lamp. Thereby, the operating voltage of the LED lamp would be larger than the input voltage provided by the electrical ballast during the preheating stage. This would, however, require increasing the number of light-emitting diodes in the LED lamp and would thus be expensive. A further solution would be to detect the high ignition voltage and to connect the lighting module of the LED lamp to the electrical ballast only after ignition has been finished. Though, this approach could result in an overcurrent at the lighting module after ignition. For reducing the flickering, a linear circuit for filtering the ripple current provided by the electrical ballast could be added to the electronic driver, but this would lead to a high power consumption of the LED lamp due to losses in the linear circuit.

SUMMARY OF THE INVENTION

In view of the above-described disadvantageous of currently available systems, it is an object of the present invention to provide an improved electronic driver for an LED lighting module. A further object is to provide an improved LED lamp.

These objects are solved by an electronic driver and an LED lamp according to the independent claims. Preferred embodiments are given by the dependent claims, the description and the drawings.

Accordingly, an electronic driver for transforming an input voltage provided by an electrical ballast into an operating voltage for an LED lighting module is provided. The electronic driver comprises a flicker eliminating circuit, which is adapted to operate in a saturation mode when the input voltage is below a threshold voltage and to operate in a switch mode when the input voltage is above a threshold voltage, wherein a voltage drop in the flicker eliminating circuit in the saturation mode is higher than in the switch mode.

Preferably, the electronic driver has inputs for receiving the input voltage and an input current provided by the electrical ballast, and outputs for providing an output voltage and an output current to the LED lighting module. The electronic driver is preferably adapted to provide an output voltage that corresponds to an operating voltage of the LED lighting module and to provide an output current that corresponds to an operating current of the LED lighting module. The operating voltage and the operating current may be intrinsic features of the LED light module.

The electrical ballast may provide an AC input voltage that is converted to a DC input voltage by the electronic driver. Since electrical ballasts are embodied current limiting, the input voltage depends on the load connected to the electrical ballast and/or the operation mode of the electrical ballast (i.e. preheating, ignition or normal mode). In the case of a light load, for example during dimming or during preheating, a low input voltage is provided by the electrical ballast. In the case of a high load, for example for normal operation and/or during ignition, a high input voltage is provided by the electrical ballast.

The flicker eliminating circuit may allow for reducing and/or eliminating a flickering in the case of a light load since a high voltage drop is present in the flicker eliminating circuit in this case. Preferably, the voltage drop corresponds to the output voltage provided by the electronic driver. In the case of a high load, the loss of the flicker eliminating circuit is reduced due to the low voltage drop. Preferably, the threshold voltage is defined by the flicker eliminating circuit.

In the switch mode, the flicker eliminating circuit may essentially show the behavior of an ohmic contact. In the saturation mode, a resistance of the flicker eliminating circuit may increase with increasing voltage drop at the flicker eliminating circuit. Preferably, in the switch mode, the flicker eliminating circuit may constitute a voltage-controlled current supply.

Hereinafter, the terms "providing", "applying", "coupling" (and so on) a voltage and/or a current to an electronic component of the electronic driver does not exclude other electronic components from being positioned in between the voltage source and/or the current source and the electronic component.

Furthermore, in this application, an indefinite article, such as "a" or "an", may be understood as singular or plural, in particular with the meaning "at least one", "one or more", etc., unless this is explicitly excluded, for example by the term "exactly one", etc.

According to at least one embodiment of the electronic driver, a resistance of the flicker eliminating circuit in the switch mode is higher than the resistance of the flicker eliminating circuit in the saturation mode. Preferably, in the case of a light load, where the flicker eliminating circuit operates in the saturation mode, the current in the flicker eliminating circuit is constant. In the case of a high load, where the flicker eliminating circuit operates in the switch mode, the current in the flicker eliminating circuit may increase with increasing input voltage.

According to at least one embodiment of the electronic driver, the flicker eliminating circuit comprises a voltage switch, wherein a gate of the voltage switch is coupled to a voltage detection circuit, which is adapted to provide a low current to the gate when the input voltage is below the threshold voltage and a high current to the control gate when the input voltage is above the threshold voltage.

The gate of the voltage switch may be the control input of the voltage switch. That is to say, a voltage applied to the gate of the voltage switch (so-called gate voltage), in particular the input voltage, may be used to operate the voltage switch. The voltage switch may further comprise a drain and a source (also called: emitter and collector). The drain and the source may respectively constitute an input and an output of the voltage switch, or vice versa. An output of the electronic driver may be coupled, preferably directly coupled, to the source or the drain. Preferably, depending on the gate voltage, the voltage switch may be in the saturation mode or in the switch mode.

According to at least one embodiment of the electronic driver, the voltage switch is a MOSFET, in particular an enhancement-mode MOSFET. Particularly preferably, the MOSFET is an enhancement mode p-channel MOSFET. A source of the voltage switch is coupled to an output of the electronic driver and a drain of the voltage switch is coupled to an input of the electronic driver or, vice versa, a drain of the voltage switch is coupled to the output and a source of the voltage switch is coupled to the input. The saturation mode may correspond to the active mode of the MOSFET. The switch mode may correspond to the triode mode of the MOSFET.

According to at least one embodiment of the electronic driver, the flicker eliminating circuit comprises a decoupling capacitor and a decoupling resistor connected in parallel to each other and to the output. The parallel connection of the decoupling capacitor and the decoupling resistor may constitute a dummy load for adjusting a time constant of the flicker eliminating circuit. In particular, by providing the decoupling capacitor and the decoupling resistor, it is possible to adjust the rising and/or falling time when the output voltage provided at the output is increased and/or decreased, respectively.

According to at least one embodiment, the electronic driver comprises an open-load detection circuit for detecting an open load at the output. An open load corresponds to an open circuit. The open-load detection circuit is adapted for providing a control voltage to a circuit switch such that the circuit switch disconnects the flicker eliminating circuit and/or the output from the input when an open load is present at the output. The circuit switch may be a transistor, in particular a MOSFET transistor. The control voltage may be applied to the gate of the circuit switch.

According to at least one embodiment of the electronic circuit, the open-load detection circuit comprises a shunt regulator that is adapted for regulating the control voltage. Preferably, the shunt regulator is coupled to the circuit switch such that, in the case of an open load, a low control voltage is provided to the circuit switch. Particularly preferably, the gate of the circuit switch is connected to ground in the case of an open load. Thereby, the circuit switch may be opened (i.e., non-conducting) in the case of an open load.

According to at least one embodiment of the electronic driver, a transient voltage suppressor (TVS) is coupled to the open-load detection circuit, wherein the transient voltage suppressor breaks down when an open load is present at the output of the electronic driver. Preferably, the transient voltage suppressor is coupled to the output of the electronic driver and/or the open-load detection circuit and/or the flicker eliminating circuit such that, in the case of an open load, the output of the electronic driver and/or the open-load detection circuit and/or the flicker eliminating circuit are decoupled from the input. Particularly preferably, the transient voltage suppressor is connected in parallel to the output of the electronic driver and/or the open-load detection circuit and/or the flicker eliminating circuit.

According to at least one embodiment of the electronic driver, a response time of the circuit switch and/or a response time of the transient voltage suppressor is such that, when an open load is present at the output, the voltage at the flicker eliminating circuit, in particular at the decoupling capacitor, rises only to a pre-defined maximum voltage during the response time, wherein the maximum voltage is lower than the input voltage. If an open load is present at the output of the electronic driver, the decoupling of the flicker eliminating circuit and/or the output from the input of the electronic driver requires a short time, for example in the range of a few Milliseconds. The time scale of this short time is mainly given by the response time of the circuit switch and/or the response time of the transient voltage suppressor. During the response time, the voltage at the flicker eliminating circuit, in particular at the decoupling capacitor, may increase up to the output voltage provided by the electrical ballast. This could result in a destruction of the flicker eliminating circuit, in particular the decoupling capacitor. By adjusting the response time of the circuit switch and/or of the transient voltage suppressor, the decoupling of the flicker eliminating circuit may occur before the voltage at the flicker eliminating circuit, in particular the decoupling capacitor, has reached a dangerous level.

According to at least one embodiment of the electronic driver, a current limiting circuit is coupled between the input and the flicker eliminating circuit, wherein the current limiting circuit is adapted to limit and/or smooth an input current provided by the electrical ballast. Preferably, the current limiting circuit comprises a capacitor.

According to at least one embodiment of the electronic driver, the electrical ballast is adapted for adjusting, in particular dimming, the input voltage according to a user input, wherein the flicker eliminating circuit is adapted for eliminating flickering of the LED lighting module during dimming. In particular, the flicker eliminating circuit is adapted for smoothing a ripple current provided to the flicker eliminating circuit.

Further, an LED lamp is provided. The LED lamp preferably comprises an electronic driver as described herein.

That is to say, all features disclosed with reference to the electronic drive are also disclosed for the LED lamp and vice versa.

The LED lamp comprises an electronic driver, in particular an electronic driver as described herein, and an LED lighting module with at least one light-emitting diode. The LED lighting module is connected to an output of the electronic driver. Preferably, the LED lamp is a retrofit LED lamp for replacing a fluorescent lamp.

BRIEF DESCRIPTION OF THE DRAWINGS

Preferred embodiments of the invention will be explained in the following, having regard to the drawings. It is shown in.

DETAILED DESCRIPTION OF THE INVENTION

In the following, exemplary embodiments of an electronic driver and an LED lamp as described herein will be described with reference to the figures. The same or similar elements or elements having the same effect may be indicated by the same reference number in multiple figures. Repeating the description of such elements may be omitted in order to prevent redundant descriptions. The figures and the size relationships of the elements illustrated in the figures among one another should not be regarded as to scale. Rather, individual elements may be illustrated with an exaggerated size to enable better illustration and/or better understanding.

Figure 1:
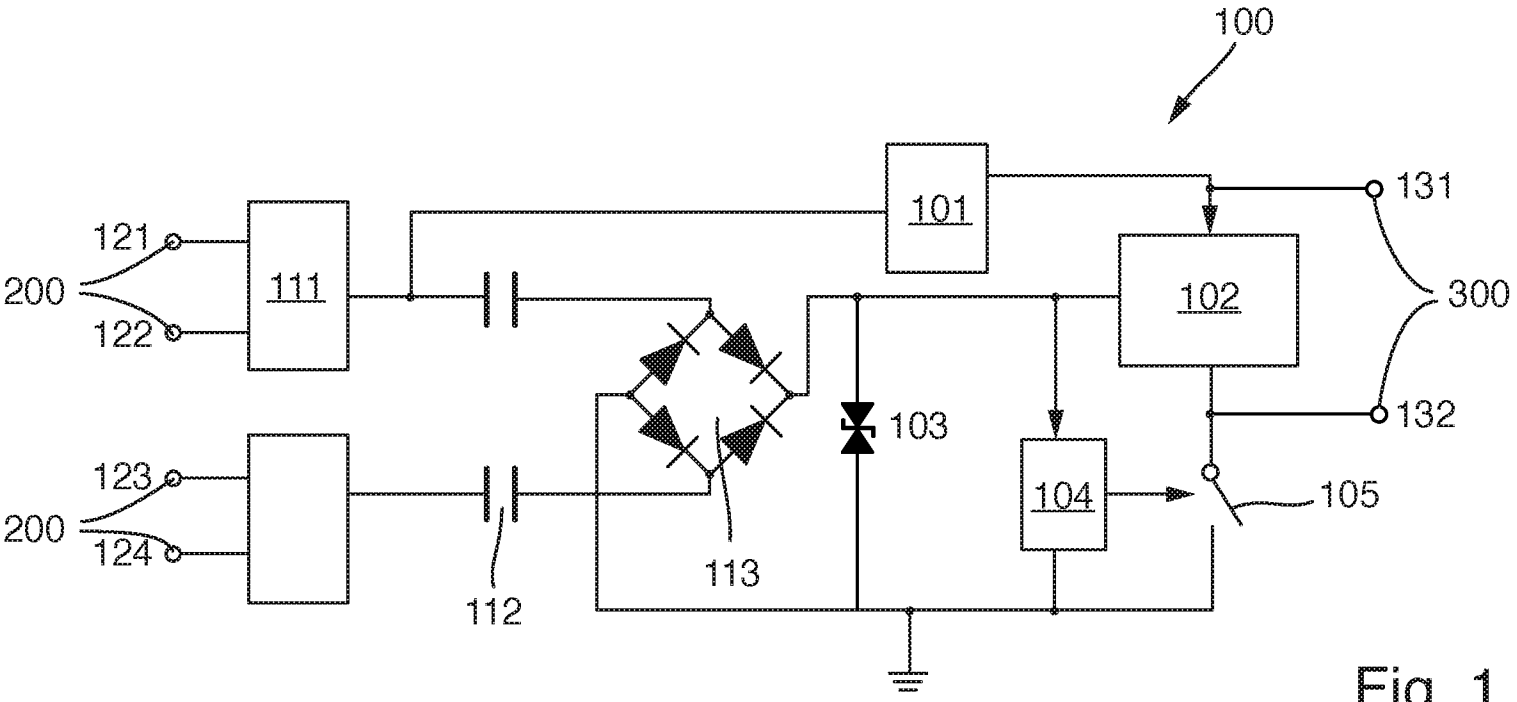
FIGS. 1 and 2 an exemplary embodiment of an electronic driver as described herein.

With reference to the schematic circuit diagram of FIG. 1, an exemplary embodiment of an electronic driver 100 described herein is described in detail. The electronic driver 100 comprises inputs 121, 122, 123, 124, a voltage detection circuit 101, a flicker eliminating circuit 102, a transient voltage suppressor 103, an open-load detection circuit 104, a circuit switch 105, a filament circuit 111, a current limiting circuit 112, a rectifier bridge 113, and outputs 131, 132.

The inputs 121, 122, 123, 124 are adjusted for being connected to an electrical ballast 200. The outputs 131, 132 are adjusted for being connected to an LED lighting module 300. The filament circuit 111 may provide an electromagnetic decoupling of the rest of the electronic driver 100 from the input 121, 122, 123, 124.

The rectifier bridge 113 is adapted for transforming the AC voltage and/or AC current provided by the electrical ballast 200 to an DC voltage and/or an DC current. The current limiting circuit 112 is coupled in between the inputs 121, 122, 123, 124 and the rectifier bridge 113. The current limiting circuit 112 is adapted to limit and/or smooth the input current provided by the electrical ballast 200.

The transient voltage suppressor 103 and the open-load detection circuit 104 are connected in parallel. In the case of an open load at the outputs 131, 132, the transient voltage suppressor 103 and/or the open-load detection circuit 104 preferably break down, i.e. are conducting, thereby providing a connection to ground and decoupling the flicker eliminating circuit 102 and the outputs 131, 132 from the inputs 121, 122, 123, 124. Further, in the case of an open load, the circuit switch 105 is opened, i.e. non-conducting, thereby removing the flicker eliminating circuit 102 from the circuit of the electronic driver 100. The circuit switch 105 may be a transistor, in particular an enhancement-mode p-channel MOSFET.

The voltage detection circuit 101 is coupled to the inputs 121, 122, 123, 124. The voltage detection circuit 101 is adapted for providing a high voltage to the flicker eliminating circuit 102 if a high voltage is provided by the inputs 121, 122, 123, 124 and a low voltage if a low voltage is provided by the inputs 121, 122, 123, 124.

Figure 2:
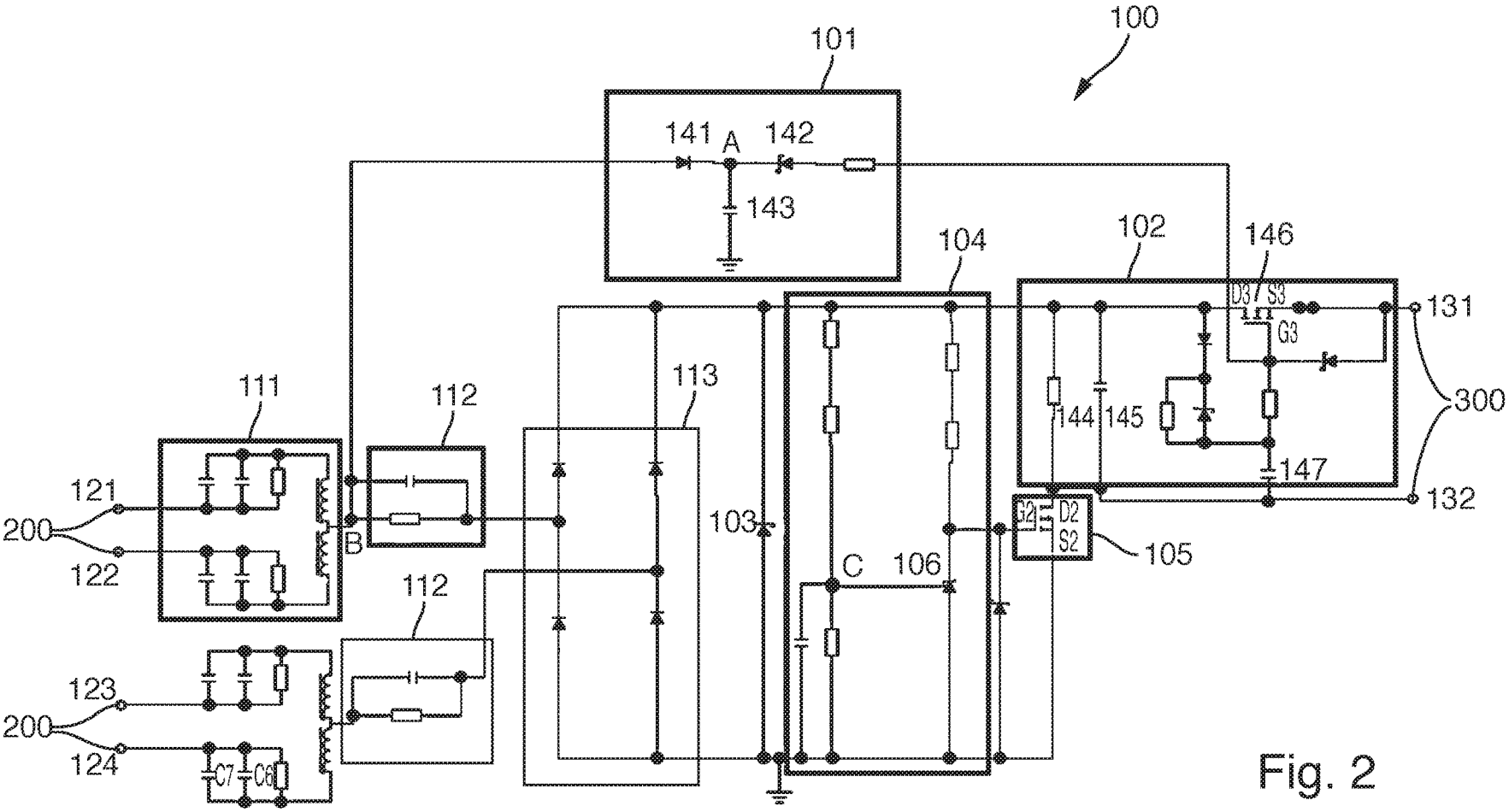

FIG. 2 shows a more detailed circuit diagram of an exemplary embodiment of an electronic driver 100 as described herein. Preferably, the circuit diagram of FIG. 2 corresponds to a detailed circuit diagram of the exemplary embodiment shown in FIG. 1.

The voltage detection circuit 101 comprises a detection diode 141, a detection capacitor 143 and a Zener diode 142. Preferably, the threshold voltage (also called: breakdown voltage) of the Zener diode 142 corresponds to the above-described threshold voltage. If the electrical ballast 200 provides a high input voltage to the electronic driver 100, in particular if the load at the outputs 131, 132 changes from a light load to a high load, the voltage at a first point B, and thus the voltage at a second point A before the Zener diode 142 of the voltage detection circuit 101, will increase. The voltage at a second point A is small for a light load and high for a high load. For a light load, the voltage at the Zener diode 142 is below the threshold voltage of the Zener diode 142. Therefore, the Zener diode 142 blocks, i.e. is non-conducting. If the voltage at the Zener diode 142 increases to above the threshold voltage, the Zener diode 142 will break and become conducting.

The output of the voltage detection circuit 101 is coupled to the gate G3 of a voltage switch 146, in particular an enhancement-mode p-channel MOSFET, of the flicker eliminating circuit 102. For a low load, a low voltage is provided to the gate G3 of the voltage switch 146. The voltage switch 146 thus is in the saturation mode. For a high load, where the voltage at the Zener diode 141 of the voltage detection circuit 101 is higher than the threshold voltage of the Zener diode 141, the voltage at the gate G3 slowly increases. Since the current at the source S3 and the drain D3 of the voltage switch 146 is constant, increasing the voltage at the gate G3 results in a shift from the saturation mode to the shift mode (triode mode) of the voltage switch 146. The voltage drop—and thus the resistance—at the drain D3 and the source S3 of the voltage switch 146 is reduced. Thereby, losses over the voltage switch 146 are reduced if a high load is connected to the outputs 131, 132.

The flicker eliminating circuit 102 further comprises a decoupling resistor 144 and a decoupling capacitor 145 that provide a dummy load for the flicker eliminating circuit 102 for adjusting the time constant of the flicker eliminating circuit 102. In particular, by this dummy load, it is possible to ensure that the voltage provided at the outputs 131, 132 increases only slowly when a high load is present at the outputs 131, 132.

Due to the flicker eliminating circuit 102, the output voltage provided by the electronic driver 100 at the outputs 131, 132 may be adjusted to different operating modes of the electrical ballast 200. During a preheating stage, for instance, the output voltage slowly increases and the LED lighting module 300 is turned off. After the preheating stage, the output voltage and the output current are increased to a value corresponding to the operating voltage and the operating current of the LED lighting module 300.

The flicker eliminating circuit 102 preferably eliminates flickering of the light-emitting diodes of the LED lighting module in the case of a light load. For this, a smoothing capacitor 147 may be coupled to the voltage switch 146 and the outputs 131, 132. In full load, losses at the flicker eliminating circuit 102 are reduced due to the voltage switch 146 being operated in the switch mode.

In the case of an open circuit at the outputs 131, 132, the voltage in the electronic driver 100 increases. Thus, the output voltage at the outputs 131, 132 would also increase. This high voltage in the circuit will trigger two processes, as explained below. Preferably, the first process takes place on a short time scale, for example at most 20 ms or at most 10 ms, whereas the second process takes place on a longer time scale, for example at least 15 ms or at least 5 ms.

First, if the voltage at a third point C in the circuit is larger than a pre-defined value, for example 2.5 V, a shunt regulator 106 in the open-load detection circuit 104 breaks down. In this case, the gate voltage at a gate G2 of the circuit switch 105 decreases, in particular pulled to ground, and the circuit switch 105 is non-conducting. Thus, the flicker eliminating circuit 102 is decoupled from the high voltage in the circuit and the decoupling capacitor 145 is protected from high voltage.

Second, for a high increase of the voltage in the circuit, the transient voltage suppressor 103 will become conducting, i.e. breakdown, and decouple also the open-load detection circuit 104 from the inputs 121, 122, 123, 124. The voltage after the rectifier bridge 113 will then be small.

Figure 3:
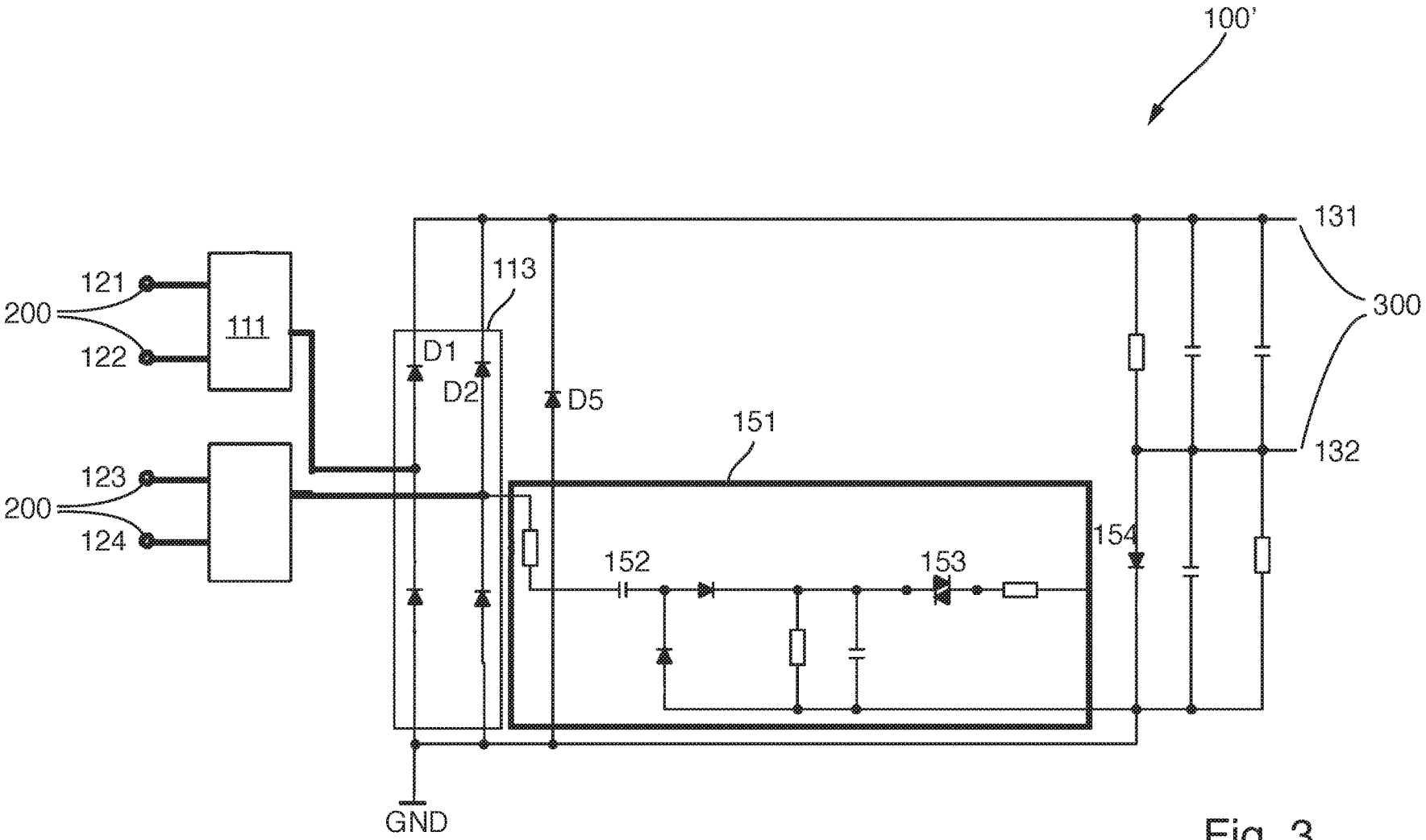
FIG. 3 an alternative embodiment of an electronic driver.

With reference to schematic circuit diagram of FIG. 3, an exemplary embodiment of an alternative driver 100' is explained in detail. The alternative driver 100' comprises an ignition voltage detection circuit 151 for detecting the high ignition voltage provided by the electrical ballast 200 during ignition. Only after the ignition has happened, the voltage at a first capacitor 152 of the ignition voltage detection circuit 151 will increase, in particular above 32 V, resulting in a bidirectional trigger diode 153 of the ignition voltage detection circuit 151 providing enough current to trigger an SCR switch 154. Such an ignition voltage detection circuit 151 has the disadvantage of causing over-currents after the ignition.

Figure 4A:
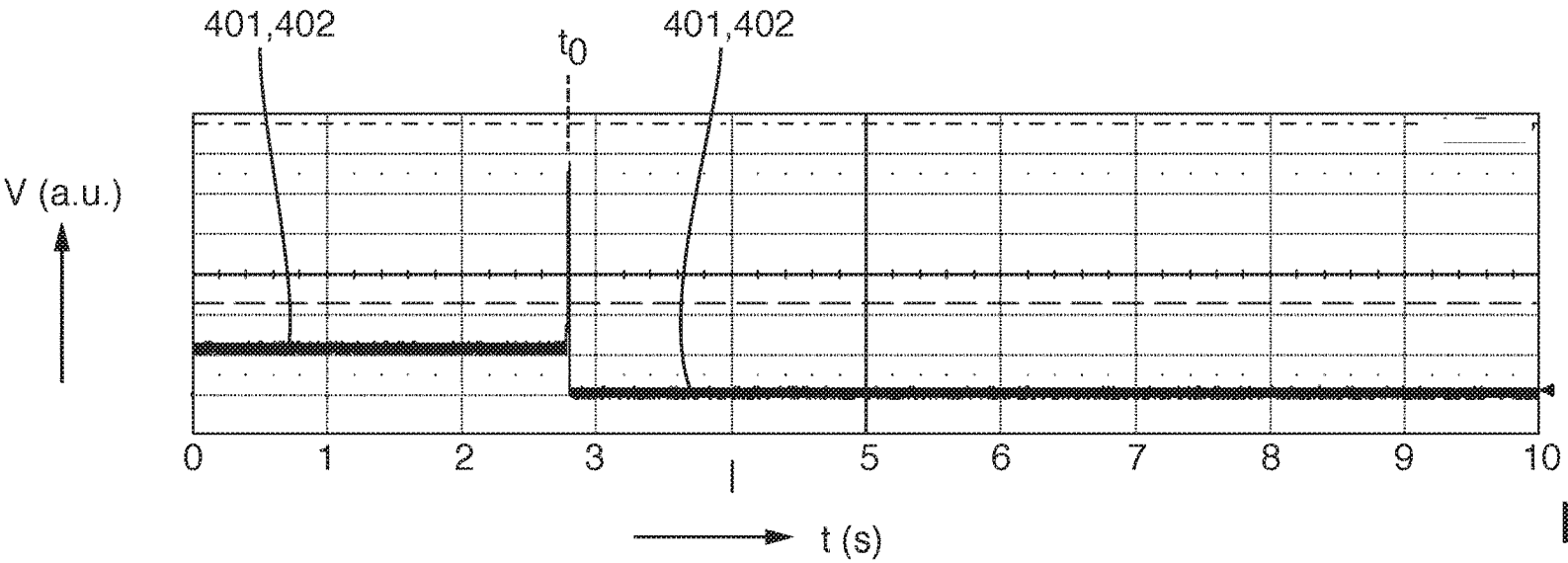
FIGS. 4A and 4B an exemplary embodiment of an electronic driver as described herein.
Figure 4B:
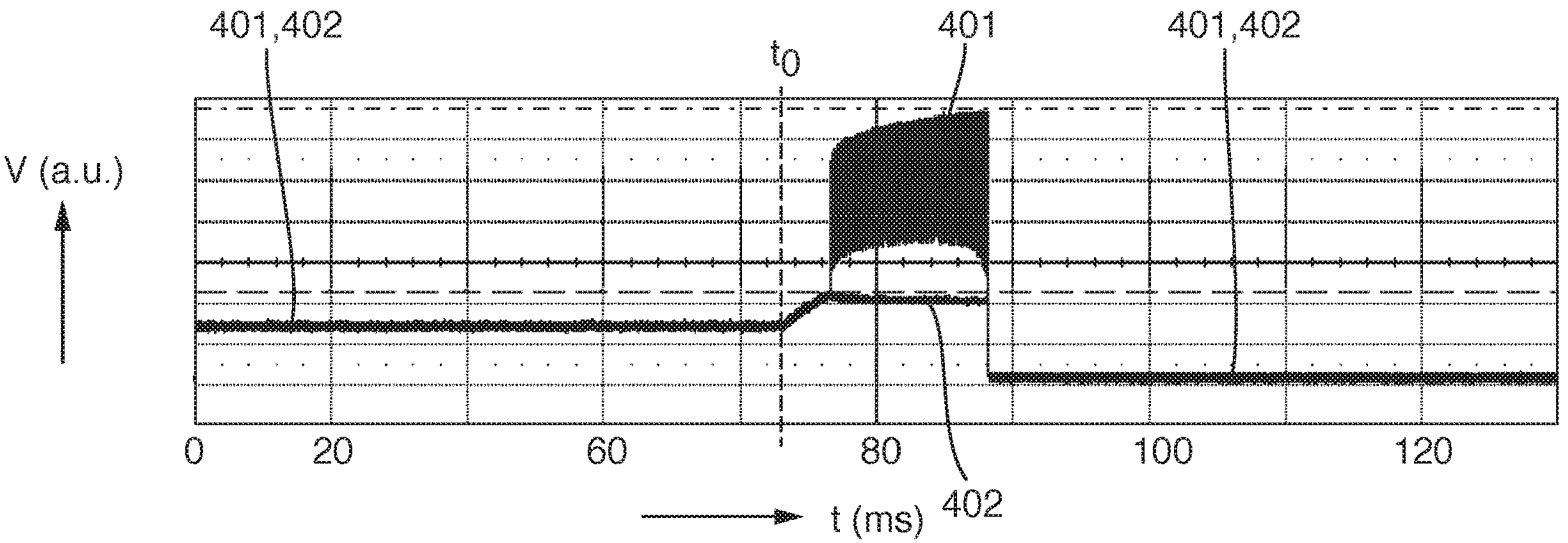

With reference to the voltage measurements of FIGS. 4A and 4B, an exemplary embodiment of an electronic driver 100 as described herein is explained in detail. FIGS. 4A and 4B show a first voltage 401 at the transient voltage suppressor 103 and a second voltage 402 at the decoupling capacitor 145. The voltages are shown in arbitrary units (a.u.) in FIGS. 4A and 4B. FIG. 4B shows a scale-up of the measurement shown in FIG. 4A.

For example, an input voltage provided by the electrical ballast 200 and/or to the electrical ballast 200 may be 277 Vac. In full load, the voltage drop between the drain D3 and the source S3 of the voltage switch 146 may be 0.4 V, corresponding to a loss of the voltage switch 146 of 0.05 W. In light load, the voltage drop between the drain D3 and the source S3 may be 4.8 V, corresponding to a loss of the voltage switch 146 of 0.024 W.

FIGS. 4A and 4B show an exemplary measurement in the case of an open load being present at the outputs 131, 132 of the electronic driver 100. The open load is present at a zero-point time t0. Before this zero-point time t0, medium second voltage 402 of around 100 V is present at the transient voltage suppressor 103 and a medium first voltage 401 is present at the decoupling capacitor 145. In the case of an open load, the second voltage 402 as well as the first voltage 401 is increased for a short time duration. This time duration may correspond to the response time of the transient voltage suppressor 103. The first voltage 401 increases to a value below a damage voltage of the decoupling capacitor 145. For example, if a voltage of 277 Vac is provided to the electronic driver 100, the first voltage 401 may increase to 190 V, wherein a damage voltage of the decoupling capacitor 145 may be 200 V. After the time duration, the first voltage 401 and the second voltage 402 drop to zero.

The invention is not restricted by the description based on the embodiments. Rather, the invention comprises any new feature and also any combination of features, including in particular any combination of features in the patent claims, even if this feature or this combination itself is not explicitly specified in the patent claims or exemplary embodiments.

LIST OF REFERENCE NUMERALS

100 electronic driver
100' alternative driver
101 voltage detection circuit
102 flicker eliminating circuit
103 transient voltage suppressor
104 open-load detection circuit
105 circuit switch
106 shunt regular
111 filament circuit
112 current limiting circuit
113 rectifier bridge
121, . . . , 124 inputs
131, 132 outputs
141 detection diode
142 Zener diode
143 detection capacitor
144 decoupling resistor
145 decoupling capacitor
146 voltage switch
147 smoothing capacitor
151 ignition voltage detection circuit
152 first capacitor
153 bidirectional trigger diode
154 SCR switch
200 electrical ballast
300 LED lighting module
401 first voltage
402 second voltage
G3,D3,S3 gate, source, drain of the voltage switch
G2,D3,S3 gate, source, drain of the circuit switch
A,B,C third, second, third point in the circuit
t0 zero-point time
t1 first time

The invention claimed is:

1. An electronic driver configured for transforming an input voltage provided by an electrical ballast into an operating voltage for a light-emitting diode (LED) lighting module, the electronic driver comprising:

a flicker eliminating circuit configured to operate in a saturation mode when the input voltage is below a threshold voltage and configured to operate in a switch mode when the input voltage is above the threshold voltage, wherein a voltage drop within the flicker eliminating circuit in the saturation mode is higher than in the switch mode.

2. The electronic driver according to claim 1, wherein a resistance of the flicker eliminating circuit in the switch mode is higher than in the saturation mode.

3. The electronic driver according to claim 1, wherein the flicker eliminating circuit comprises a voltage switch, wherein a gate of the voltage switch is coupled to a voltage detection circuit configured to provide:

a low current to the gate when the input voltage is below the threshold voltage; and a high current to the gate when the input voltage is above the threshold voltage.

4. The electronic driver according to claim 3, wherein the voltage switch is a (MOSFET), and wherein:

a source of the voltage switch is coupled to an output of the electronic driver; and a drain of the voltage switch is coupled to an input of the electronic driver.

5. The electronic driver according to claim 3, wherein the voltage switch is a (MOSFET), and wherein:

a drain of the voltage switch is coupled to the output; and a source of the voltage switch is coupled to the input.

6. The electronic driver according to claim 1, wherein the flicker eliminating circuit comprises a decoupling capacitor and a decoupling resistor connected in parallel to each other and to an output of the electronic driver.

7. The electronic driver according to claim 1, further comprising an open-load detection circuit for detecting an open load at an output of the electronic driver, wherein the open-load detection circuit is configured for providing a control voltage to a circuit switch such that the circuit switch disconnects at least one of the flicker eliminating circuit and the output from an input of the electronic driver when an open load is present at the output.

8. The electronic driver according to claim 7, wherein the open-load detection circuit comprises a shunt regulator configured for regulating the control voltage.

9. The electronic driver according to claim 7, further comprising a transient voltage suppressor coupled to the open-load detection circuit, wherein the transient voltage suppressor breaks down when an open load is present at the output.

10. The electronic driver according to claim 9, wherein at least one of a response time of the circuit switch and a response time of the transient voltage suppressor is such that, when an open load is present at the output, a voltage at the flicker eliminating circuit rises only to a pre-defined maximum voltage during the response time, wherein the pre-defined maximum voltage is lower than the input voltage.

11. The electronic driver according to claim 1, further comprising a current limiting circuit coupled between an input of the electronic driver and the flicker eliminating circuit, wherein the current limiting circuit is configured to at least one of limit and smooth an input current provided by the electrical ballast.

12. The electronic driver according to claim 1, wherein the electrical ballast is configured for adjusting the input voltage according to a user input.

13. A light-emitting diode (LED) lamp comprising:

the electronic driver according to claim 1; and the LED lighting module wherein the LED lighting module comprises at least one LED and is connected to an output of the electronic driver.

14. An electronic driver comprising a flicker eliminating circuit configured to operate in a saturation mode when an input voltage provided by an electrical ballast is below a threshold voltage and configured to operate in a switch mode when the input voltage is above the threshold voltage, wherein a voltage drop within the flicker eliminating circuit in the saturation mode is higher than in the switch mode, wherein the electronic driver is configured to transform the input voltage provided by the electrical ballast into an operating voltage for a light-emitting diode (LED) lighting module.

15. A light-emitting diode (LED) lamp comprising:

the electronic driver according to claim 14; and the LED lighting module wherein the LED lighting module comprises at least one LED and is connected to an output of the electronic driver.

16. An electronic driver comprising a flicker eliminating circuit configured to operate in a saturation mode when an input voltage provided by an electrical ballast is below a threshold voltage and configured to operate in a switch mode when the input voltage is above the threshold voltage, wherein a voltage drop within the flicker eliminating circuit in the saturation mode is higher than in the switch mode.

17. A light-emitting diode (LED) lamp comprising:

the electronic driver according to claim 16; and an LED lighting module wherein the LED lighting module comprises at least one LED and is connected to an output of the electronic driver.

* * * * *